US008743041B2

(12) United States Patent
Kuriyama et al.

(10) Patent No.: US 8,743,041 B2
(45) Date of Patent: Jun. 3, 2014

(54) LIQUID CRYSTAL DISPLAY DRIVE CIRCUIT AND LIQUID CRYSTAL DISPLAY DEVICE

(75) Inventors: Toru Kuriyama, Osaka (JP); Hisashi Yamaguchi, Osaka (JP); Hiromasa Asada, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 579 days.

(21) Appl. No.: 12/998,481

(22) PCT Filed: Oct. 28, 2009

(86) PCT No.: PCT/JP2009/068509
§ 371 (c)(1),
(2), (4) Date: Apr. 26, 2011

(87) PCT Pub. No.: WO2010/050511
PCT Pub. Date: May 6, 2010

(65) Prior Publication Data

US 2011/0205203 A1 Aug. 25, 2011

(30) Foreign Application Priority Data

Oct. 30, 2008 (JP) ..... 2008-280342

(51) Int. Cl.
*G09G 3/36* (2006.01)

(52) U.S. Cl.
USPC ..... 345/97; 345/100

(58) Field of Classification Search
USPC ..... 345/97–100
See application file for complete search history.

(56) References Cited

U.S. PATENT DOCUMENTS 5,233,447 A 8/1993 Kuribayashi et al.
(Continued)

FOREIGN PATENT DOCUMENTS

| | | |
|---|---|---|
| GB | 2175726 | 12/1986 |
| JP | 62-211620 | 9/1987 |
| JP | 02-116823 | 5/1990 |
| JP | 07-064056 | 3/1995 |

(Continued)
OTHER PUBLICATIONS

International Search Report dated Nov. 24, 2009.

*Primary Examiner* — Joe H Cheng
*Assistant Examiner* — Steven Holton
(74) *Attorney, Agent, or Firm* — Harness, Dickey & Pierce, P.L.C.

(57) ABSTRACT

In order to carry out a display reset operation, a segment driver and a common driver are driven to operate as below during a display data reading period in which voltages to be applied to a liquid crystal display panel are nonuniform between lines. First, a shift register and a level shifter which are provided in the segment driver and a shift register and a level shifter which are provided in the common driver are driven to operate as usual, whereas a display control signal supplied from a controller causes output circuits to stop carrying out their respective output operations. In at least one embodiment, during a period in which a writing operation is carried out with respect to the liquid crystal display panel so as to carry out the display reset operation, the display control signal supplied from the controller allows the output circuits to carry out the respective output operations. This allows a memory (e.g., cholesteric) liquid crystal display device to carry out a display reset operation without causing display unevenness by simultaneously selecting a plurality of lines.

4 Claims, 7 Drawing Sheets

(56) References Cited

U.S. PATENT DOCUMENTS

| | | | | |
|---|---|---|---|---|
| 5,615,027 | A | 3/1997 | Kuribayashi et al. | |
| 6,154,189 | A * | 11/2000 | Tamura et al. | 345/89 |
| 7,130,013 | B2 * | 10/2006 | Burberry et al. | 349/187 |
| 2002/0044117 | A1 | 4/2002 | Matsumura et al. | |
| 2002/0057239 | A1 | 5/2002 | Hiji et al. | |
| 2006/0103641 | A1 * | 5/2006 | Marhefka | 345/204 |
| 2007/0097062 | A1 | 5/2007 | Sawada | |

FOREIGN PATENT DOCUMENTS

| | | |
|---|---|---|
| JP | 2002-040391 | 2/2002 |
| JP | 2002-072968 | 3/2002 |
| JP | 2004-198808 | 7/2004 |
| JP | 2005-257999 | 9/2005 |
| JP | 2005-266163 | 9/2005 |
| JP | 2007-148351 | 6/2007 |
| JP | 2007-304527 | 11/2007 |

* cited by examiner

LIQUID CRYSTAL DISPLAY DRIVE CIRCUIT AND LIQUID CRYSTAL DISPLAY DEVICE

TECHNICAL FIELD

The present invention relates to a liquid crystal display drive circuit which can prevent display unevenness that occurs during a display reset operation carried out in a cholesteric liquid crystal display device, and to a liquid crystal display device including the liquid crystal display drive circuit.

BACKGROUND ART

A cholesteric liquid crystal is a bistable material which has an unstable phase called a homeotropic phase and stable phases called focal conic and planar phases. A voltage application by various methods can cause a transition between the respective phases. A cholesteric liquid crystal which is in a focal conic state or in a planar state is also in a stable state after a voltage application to liquid crystals is stopped. Therefore, such a cholesteric liquid crystal is used as a memory liquid crystal. Such a characteristic of cholesteric liquid crystal causes active development of cholesteric liquid crystal display devices.

A cholesteric liquid crystal display device includes a liquid crystal panel having a simple matrix electrode structure, a common driver for driving a common electrode, and a segment driver for driving a segment electrode. A method for driving such a cholesteric liquid crystal display device is roughly classified into a conventional drive method and a DDS (Dynamic Drive Scheme) drive method (see Patent Literature 1).

The conventional drive method can be simply carried out by use of a driver of a general-purpose STN (Super Twisted Nematic) liquid crystal display device. In order to obtain a planar state by the conventional drive method, a voltage of not less than a given voltage Vp is applied for a given time. In order to obtain a focal conic state by the conventional drive method, a given voltage Vfc is applied for a given time. In order to obtain a uniform display state, a full screen is uniformly reset to be in a planar state and further to be in a focal conic state, so that writing is carried out.

The DDS drive method can be carried out in a shorter voltage application time than the conventional drive method. The DDS drive method includes the following three steps: (i) resetting a full screen to be in a planar state at one time, (ii) applying "a voltage pulse for determining a final state" for a short time"; and (iii) applying a retention voltage called a non-selection voltage so as to cause a final state.

Patent Literature 2 discloses a method in which according to the DDS drive method, a non-selection period of time is optimized, so as to remove display unevenness. Patent Literature 3 discloses a method in which according to the DDS drive method, an entire screen is in a non-selection state after a non-selection period, so as to close a contrast difference between a first line and a final line. Patent Literature 4 discloses a method in which according to the conventional drive method, a segment mode and a common mode of a driver are switched, so as to simply carry out a reset operation on a full screen.

CITATION LIST

Patent Literature 1

Japanese Patent Application Publication, Tokukai, No. 2007-148351 A (Publication Date: Jun. 14, 2007)

Patent Literature 2

Japanese Patent Application Publication, Tokukai, No. 2004-198808 A (Publication Date: Jul. 15, 2004)

Patent Literature 3

Japanese Patent Application Publication, Tokukai, No. 2005-257999 A (Publication Date: Sep. 22, 2005)

Patent Literature 4

Japanese Patent Application Publication, Tokukai, No. 2007-304527 A (Publication Date: Nov. 22, 2007)

SUMMARY OF INVENTION

Technical Problem

In order to drive cholesteric liquid crystals (according to the conventional drive method), a reset operation needs to be carried out in advance of a writing operation as described earlier so as to remove display unevenness due to a previous display pattern. However, since the cholesteric liquid crystals require a comparatively long writing period (several ms for each line), a plurality of common electrodes are frequently simultaneously selected on a full screen or as described in FIG. 6 so that the reset operation is carried out in a shorter time.

The reset operation carried out by selecting a plurality of lines has raised a problem that shades appear in a display in cycles of a width W of the selected plurality of lines. Such a phenomenon is noticeable in an intermediate state (e.g., a halftone) in which a reflectance sharply changes (see FIG. 7). This causes a problem in a case where a cholesteric liquid crystal display device carries out a gradation display.

It is known that, in a case where an application voltage is set to a fixed voltage, a reflectance of cholesteric liquid crystals is influenced by not only a pulse width but also how an alternating current voltage is applied to the cholesteric liquid crystals.

FIG. 8 illustrates a change over time in voltage VLCD (segment-common voltage) which is applied to respective pixels belonging to one (1) line defined by one (1) common electrode and a plurality of segment electrodes during the writing operation. FIG. 8 illustrates a case in which identical data is written to all pixels belonging to one (1) line.

A scanning start signal YD is "H", so as to generate a selection signal for selecting a first line (see FIG. 8). A segment driver causes a shift register to sequentially transfer display data signals D0 through D3 in sync with a data shift clock XCK during a period T01 followed by a writing period T11 in which the first line is subjected to writing. The display data signals D0 through D3 thus transferred are latched for each of segment electrodes at a timing of a latch pulse LP at which timing data for the first line is outputted at the end of the writing period T01, so as to be supplied to the respective segment electrodes as writing voltages. A common driver causes a shift register to sequentially transfer the scanning start signal YD in sync with the latch pulse LP, so that selection voltages are line-sequentially selected for each of common electrodes.

The display data signals D0 through D3 for a second line are similarly sequentially transferred immediately after the start of the writing period T11, so as to be latched in sync with the latch pulse LP and then to be outputted at the end of the writing period T11 in which the first line is subjected to writing. Transfer, latch, and output are carried out over such two periods.

A voltage in accordance with such a waveform is sequentially applied to the respective common electrodes in a case where only one line is driven. Polarities of the voltage VLCD which is applied to the respective pixels belonging to one (1) line reverse at a ratio of 1:1 in accordance with an alternating signal FR.

FIG. 9 illustrates waveforms of the respective signals which waveforms are obtained when a planar reset operation is carried out by selecting a plurality of lines. FIG. 10 illustrates a change over time in voltages which are applied to respective first through Nth lines when the N lines are selected so as to be simultaneously driven. The N lines are started to be in a selection state at respective selection start timings ts1, ts2, . . . , tsN, and the selection state of the N lines is ended at respective selection end (selection reset) timings te1, te2, . . . teN (see FIG. 10). Voltages applied to the respective N lines which are in a selection state are illustrated in solid lines, and voltages applied to the respective N lines which are in a non-selection state (voltages which are not contributory to a change in state in which lines are sequentially selected) are illustrated in dotted lines.

The segment driver causes the shift register to sequentially transfer the display data signals D0 through D3 (planar=1, focal conic=0) in sync with the data shift clock XCK during a period T1 (a data reading period). The display data signals D0 through D3 thus transferred are latched for each of the segment electrodes in sync with the latch pulse LP. The common driver causes the shift register to sequentially shift the scanning start signal YD in sync with the latch pulse LP during the period T1, so that the scanning start signal YD is outputted for each of the common electrodes. A voltage is applied to a liquid crystal display panel during the period T1. The display data signals D0 through D3 latched during the period T1 are supplied to the respective segment electrodes as writing voltages during a period T2 (a writing period) following the period T1.

The common driver causes a shift pulse by which the scanning start signal YD has been shifted in sync with the latch pulse LP (see FIG. 9) to output selection voltages. This causes the selection voltages to be supplied to the respective lines at timings shifted by a time interval equivalent to a width of the latch pulse LP (see FIG. 10). The selection state of the first line and the Nth line are ended at different timings when simultaneous selection of subsequent N lines is started. This causes the first line and the Nth line to have different waveforms of the selection signal for one (1) horizontal period (1H). According to this, how cholesteric liquid crystals are reset is also different in the first line and the Nth line. This seems to be a cause of producing gradation unevenness. Same applies to a case where a focal conic reset is carried out. As described earlier, a timing at which the selection state starts serves as a cause for waveform asymmetry. It seems that especially waveform asymmetry which occurs at the time of a transition from the selection state to the non-selection state after the writing period is a greatly contributory cause of producing gradation unevenness.

The present invention has been made in view of the problems, and its object is to provide a memory (e.g., cholesteric) liquid crystal display device which allows a simultaneous selection of a plurality of lines so as to carry out a display reset operation without causing display unevenness.

Solution to Problem

In order to attain the object, a liquid crystal display drive circuit in accordance with the present invention, which is provided in a cholesteric liquid crystal display device in which (i) pixels are provided at intersections of a plurality of common electrodes and a plurality of segment electrodes and (ii) each line is defined by pixels belonging to a corresponding one of the plurality of common electrodes, the liquid crystal display drive circuit includes: a common driver in which a selection signal for selecting a common electrode is generated in accordance with a plurality of liquid crystal drive supply voltages by sequentially shifting a scanning start signal; a segment driver in which a writing signal to be supplied to a segment electrode is generated in accordance with display data; and output control means which (i) during a reading period, causes an output circuit to stop outputting the selection signal and the writing signal while causing the scanning start signal to continue to be shifted and (ii) during a writing period, allows the output circuit to output the selection signal and the writing signal, the reading period being a period in which (i) the scanning start signal is shifted so that the selection signal is generated with respect to a plurality of lines by the common driver and (ii) the display data is read so that the writing signal to be used for a reset operation is generated by the segment driver, the writing period being a period in which the writing signal to be used for the reset operation is outputted.

According to the arrangement, during the reading period, the output control means (i) causes the scanning start signal to continue to be shifted as usual during the reading period and (ii) causes the output circuit to stop carrying out the output operation, so that the reset operation is carried out. This prevents a voltage in accordance with the selection signal and the writing signal from being applied to a liquid crystal display panel. During the writing period, the output control means causes the output circuit to carry out the output operation in accordance with the display data read during the reading period. This allows an application, to the liquid crystal panel, of a voltage in accordance with the selection signal and the writing signal which are used for the reset operation and whose waveforms are uniform between the lines. This can prevent an occurrence of display unevenness due to the non-uniform signal waveforms obtained during the reading period (see the period T1 of FIG. 10) (see FIG. 6).

Advantageous Effects of Invention

As described earlier, in order to reset previous display contents, the liquid crystal display drive circuit in accordance with the present invention includes output control means which (i) during a reading period, causes an output circuit to stop outputting the selection signal and the writing signal while causing the scanning start signal to continue to be shifted and (ii) during a writing period, allows the output circuit to output the selection signal and the writing signal, the reading period being a period in which (i) the scanning start signal is shifted so that the selection signal is generated with respect to a plurality of lines by the common driver and (ii) the display data is read so that the writing signal to be used for a reset operation is generated by the segment driver, the writing period being a period in which the writing signal to be used for the reset operation is outputted. This prevents a voltage from being applied to a liquid crystal display panel during the reading period. Therefore, in the liquid crystal display panel, to the selected plurality of lines, no voltage is applied during the reading period, whereas a voltage to carry out a display reset operation is applied during the writing period. As a result, since drive signals whose waveforms are identical are supplied to the respective selected plurality of lines, it is possible to prevent display unevenness which occurs in a conventional liquid crystal display device during the display reset operation. This brings about an effect of enhancing a display quality in a liquid crystal display device.

Figure 4:
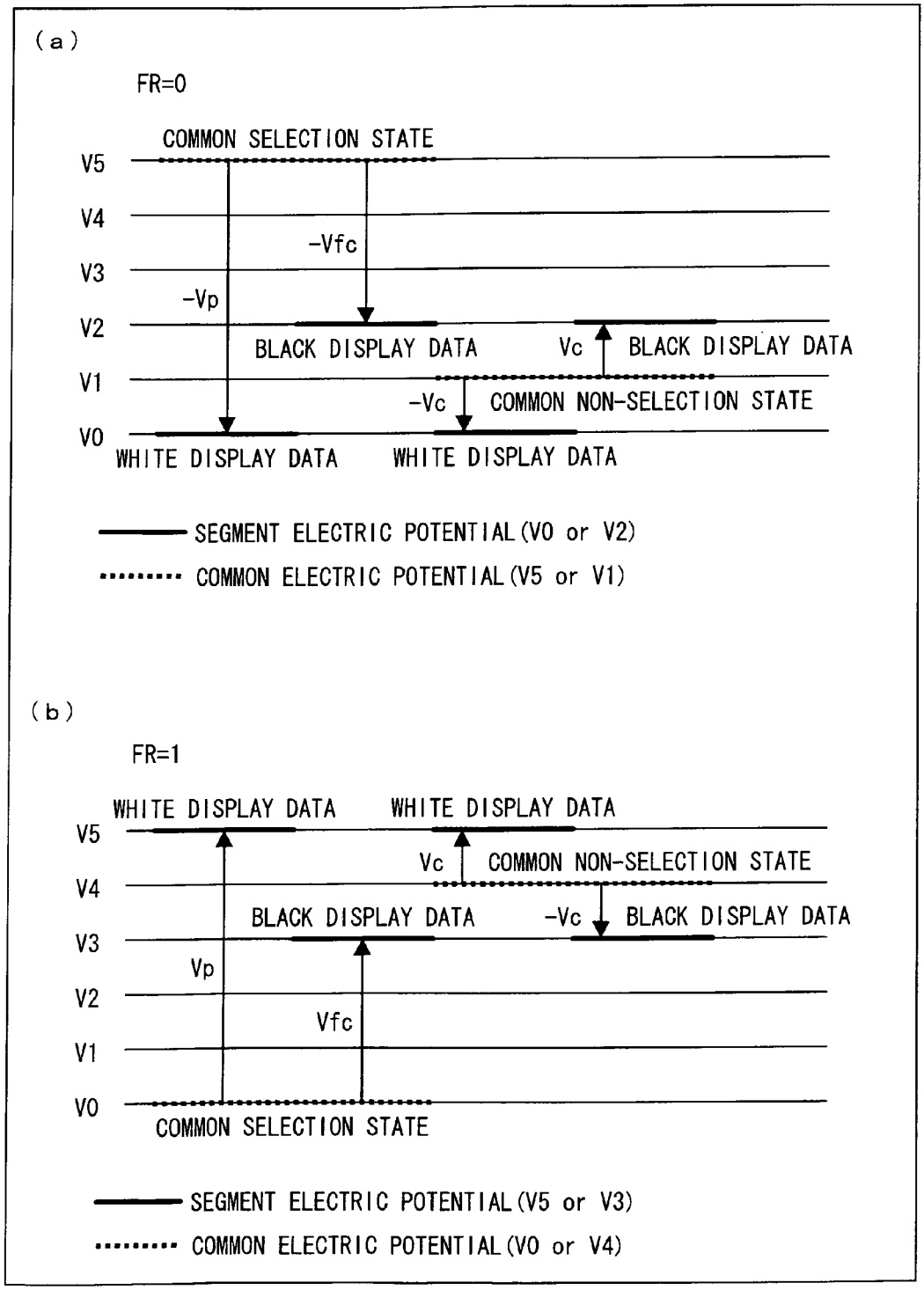

(a) and (b) of FIG. 4 illustrate patterns of voltages to be applied to liquid crystals in each of the liquid crystal display devices.

Figure 5:
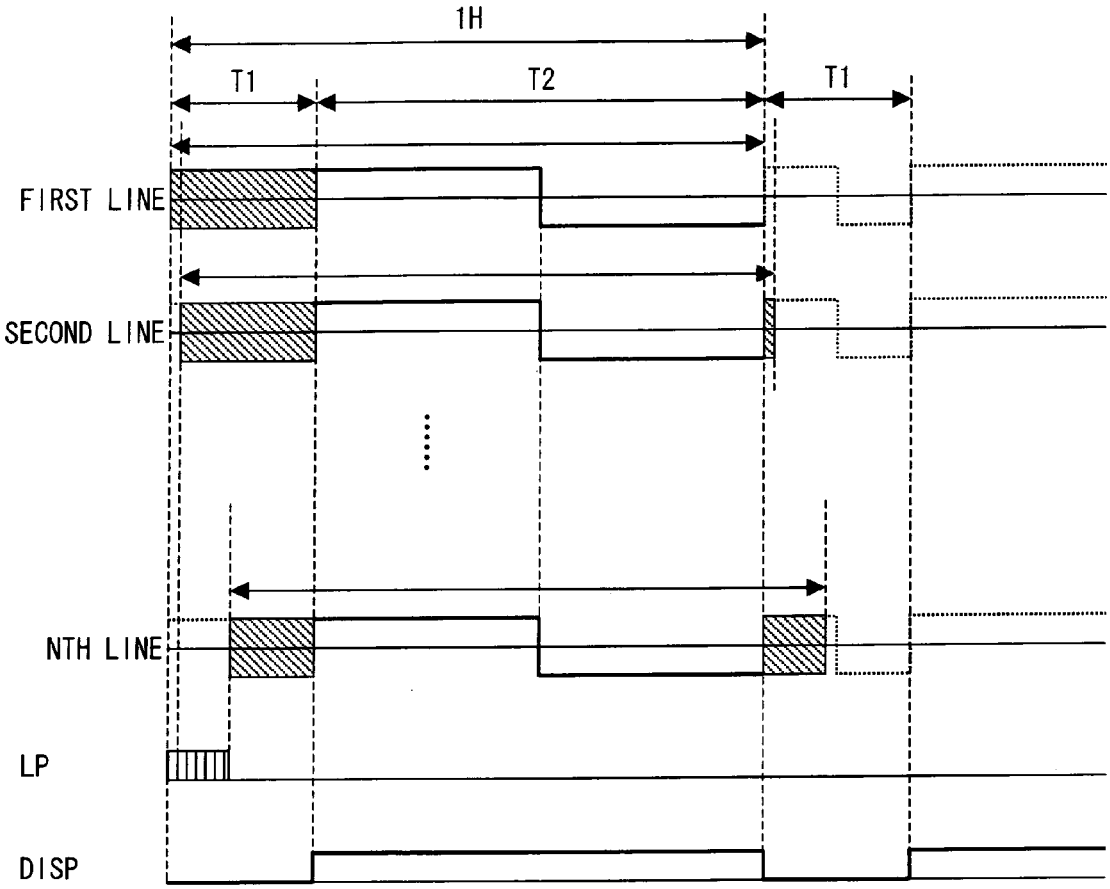

FIG. 5 is a waveform chart illustrating common electrode drive waveforms obtained during a display reset operation carried out in each of the liquid crystal display devices.

Figure 6:
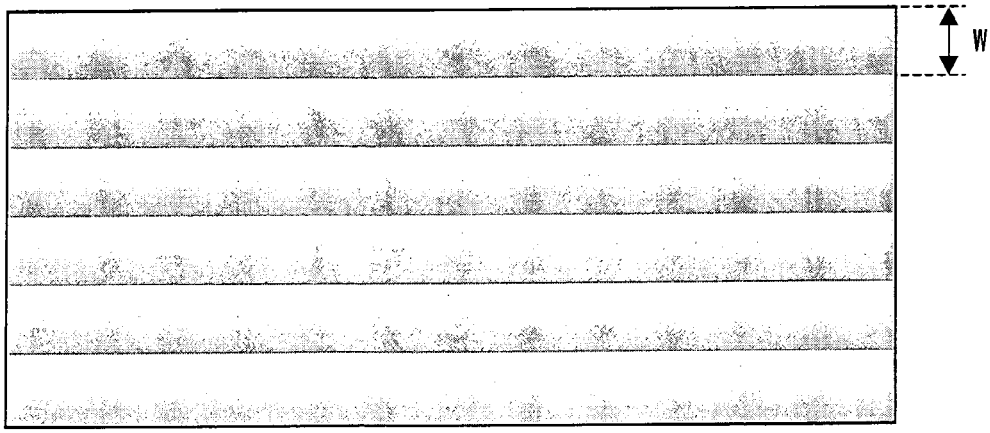

FIG. 6 illustrates a state of display unevenness which occurs during the display reset operation carried out in a conventional liquid crystal display device.

Figure 7:
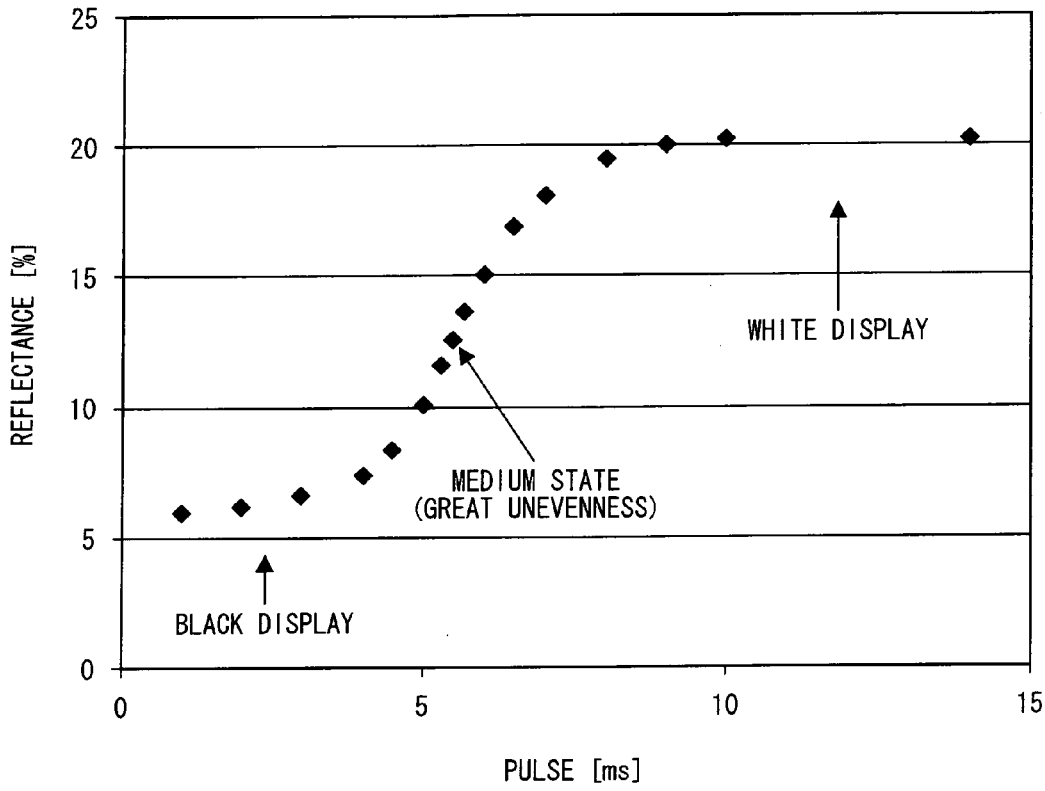

FIG. 7 is a drive characteristic chart illustrating a relationship between a write pulse width and a reflectance of a cholesteric liquid crystal.

Figure 8:
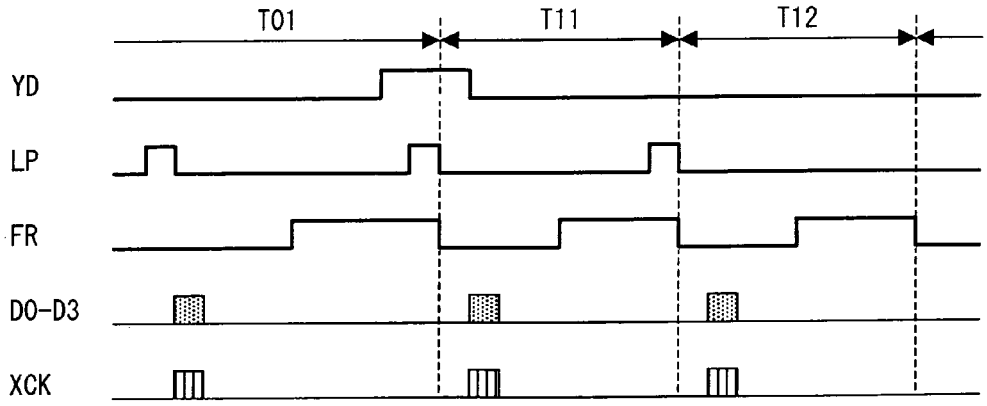

FIG. 8 is a timing chart illustrating how a drive circuit operates when one (1) line is selected so as to carry out the display reset operation in a conventional cholesteric liquid crystal display device.

Figure 9:
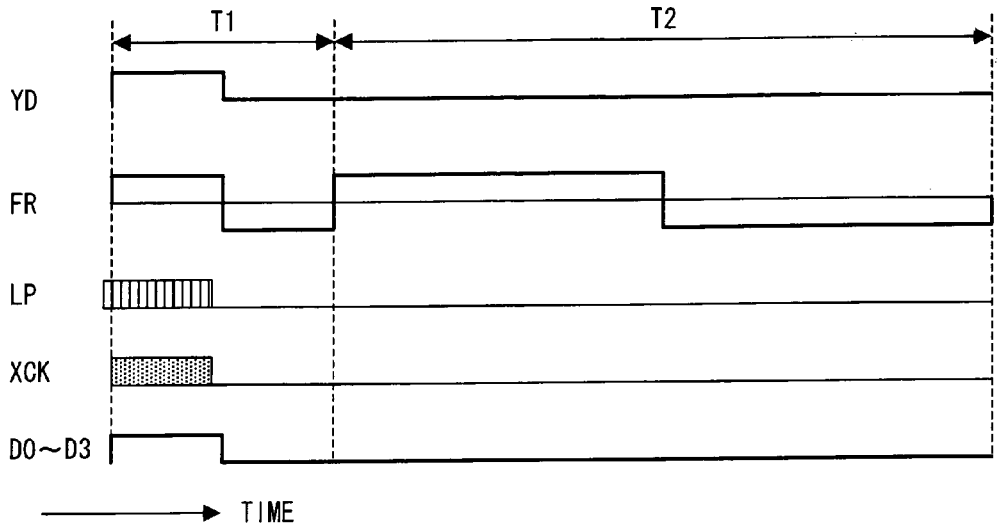

FIG. 9 is a timing chart illustrating how the drive circuit operates when a plurality of lines are simultaneously selected so as to carry out the display reset operation in the conventional cholesteric liquid crystal display device.

Figure 10:
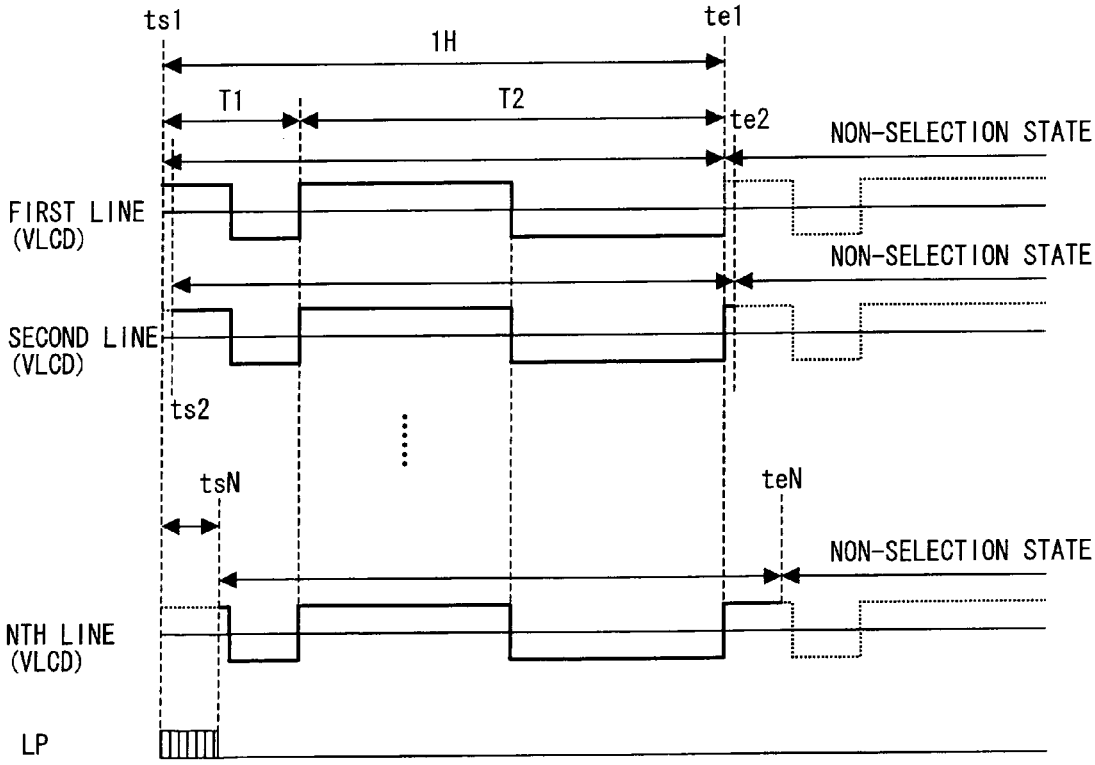

FIG. 10 is a waveform chart illustrating common electrode drive waveforms obtained when the plurality of lines are simultaneously selected so as to carry out the display reset operation in the conventional cholesteric liquid crystal display device.

DESCRIPTION OF EMBODIMENTS

An embodiment of the present invention is described below with reference to FIGS. 1 through 5.

Figure 1:
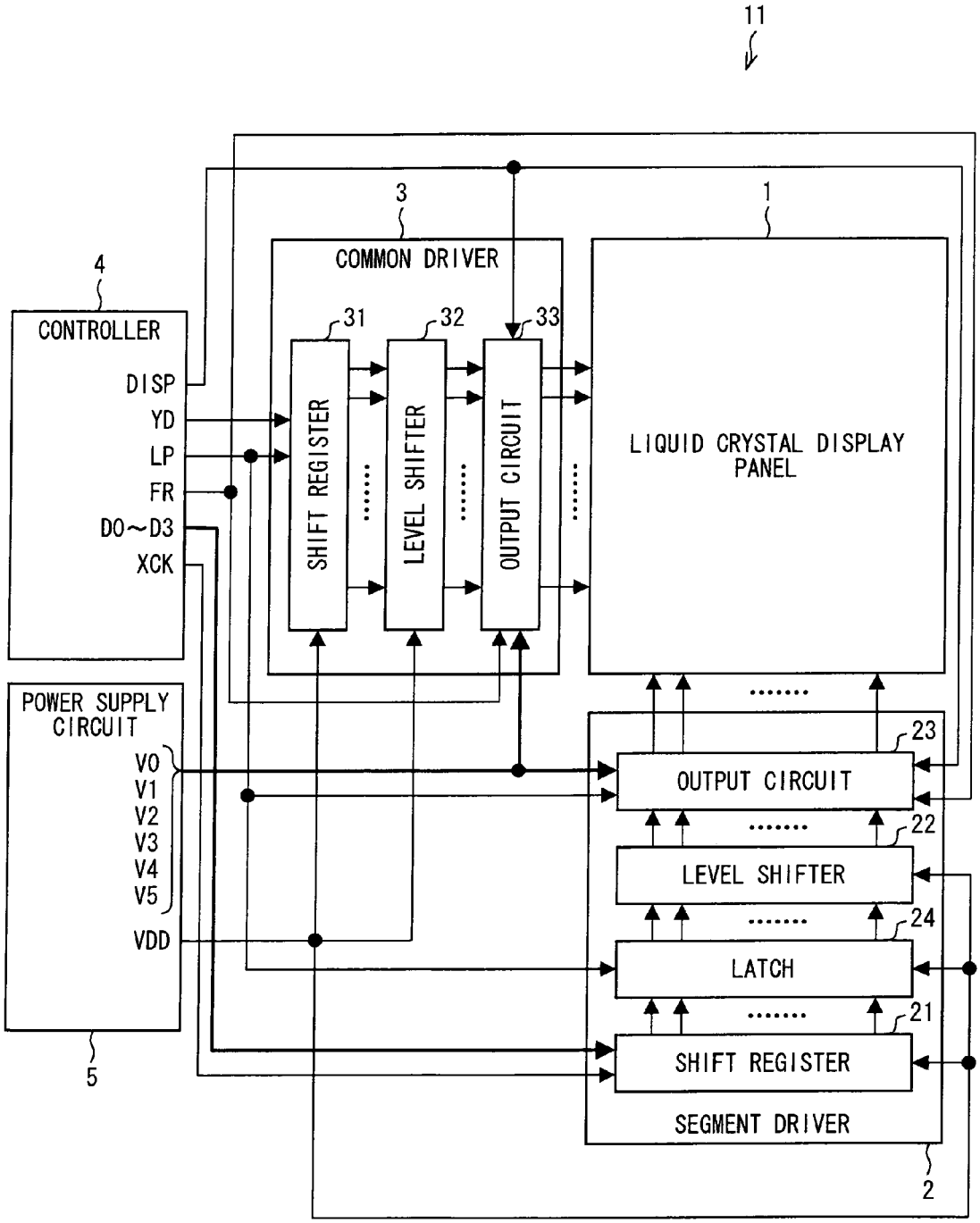
FIG. 1 is a block diagram illustrating an arrangement of a liquid crystal display device showing a first embodiment of the present invention.

FIG. 1 illustrates an arrangement of a liquid crystal display device 11 in accordance with the present embodiment.

The liquid crystal display device 11 includes a liquid crystal display panel 1, a segment driver 2, a common driver 3, a controller 4, and a power supply circuit 5.

The liquid crystal display panel 1 of a simple (passive) matrix type includes a plurality of common electrodes (not illustrated) and a plurality of segment electrodes (not illustrated). The plurality of common electrodes, which are linear transparent electrodes having a given width, are provided so as to be parallel to each other on one of opposite surfaces of two transparent substrates which face each other. The plurality of segment electrodes are linear transparent electrodes having a given width, and data voltages (writing signals) are applied to the respective plurality of segment electrodes. The plurality of segment electrodes are provided so as to be parallel to each other on the other of the opposite surfaces of the two transparent substrates which face each other.

The plurality of common electrodes and the plurality of segment electrodes are provided so as to be at right angles to each other, and pixels are provided at intersections of the plurality of common electrodes and the plurality of segment electrodes. A space between the two transparent substrates is filled with memory liquid crystals, and a voltage of a difference between a voltage to be applied to a common electrode of a corresponding pixel and a voltage to be applied to a segment electrode of the corresponding pixel is applied to a memory liquid crystal. An alignment of the memory liquid crystals changes depending on an application voltage, so that a display is changed. For example, cholesteric liquid crystals are used as the memory liquid crystals. One (1) line is defined by all pixels belonging to one (1) common electrode.

The segment driver 2 is a drive circuit which supplies, to the segment electrode, any one of liquid crystal drive voltages V0 through V5 in accordance with display data signals D0 through D3. The segment driver 2 is provided as an integrated circuit. The segment driver 2 includes a shift register 21, a latch 24, a level shifter 22, and an output circuit 23.

The shift register 21 transfers the display data signals D0 through D3 in a 4 bit transfer mode in sync with a data shift clock XCK, so as to output the display data signals D0 through D3. The latch 24 latches, at a timing of a change in latch pulse LP from "H" to "L", the display data signals D0 through D3 supplied from the shift register 21. The level shifter 22 shifts electric potentials of output data supplied from respective outputs of the shift register 21. The level shifter 22 has a function of converting a signal which has been supplied from a logic system and has a low voltage to a signal which has a high voltage to drive liquid crystals. The level shifter 22 shifts electric potentials of output data supplied from respective outputs of the latch 24.

In accordance with the display data signals obtained from the electric potential shift carried out by the level shifter 22, the output circuit 23 outputs a voltage selected from the liquid crystal drive supply voltages V0, V2, V3, and V5. One of two midpoint electric potentials of the segment electrode is selected by two values of an alternating signal FR, so that an electric potential of the segment electrode (a segment electric potential) which has a reverse polarity to an electric potential of the common electrode (a common electric potential) is set in the output circuit 23. For example, the output circuit 23 selects (i) the voltage V0 as white display data and (ii) the voltage V2 as black display data when the alternating signal FR is 0 (zero). The output circuit 33 selects (i) the voltage V5 as the white display data and (ii) the voltage V3 as the black display data when the alternating signal FR is 1. The output circuit 23 carries out an output operation when a display control signal DISP is "H" and stops carrying out the output operation when the display control signal DISP is "L".

The common driver 3 is a drive circuit which supplies a selection signal to a common electrode which is used for a display and supplies a non-selection signal to a common electrode which is not used for a display. The common driver 3 is provided as an integrated circuit. The common driver 3 includes a shift register 31, a level shifter 32, and an output circuit 33.

In a case where one (1) line is selected, the shift register 31 outputs a scanning start signal YD outputted only once while sequentially transferring the scanning start signal YD to each of shift registers in sync with the latch pulse LP. In a case where a plurality of (N) lines are selected, the shift register 31 outputs the scanning start signal YD outputted N times while sequentially transferring the scanning start signal YD to each of the shift registers in sync with the latch pulse LP. This causes the first line through the Nth line to be in a selection state, so that such a state of the plurality of lines is sequentially transferred.

The level shifter 32 is a circuit which shifts an electric potential of the scanning start signal YD (shift pulses) supplied from the respective outputs of the shift registers 31.

The output circuit 33 supplies, from the liquid crystal drive supply voltages V0 through V5, a selection voltage pattern for each of the shift pulses during a selection period defined by the shift pulses whose electric potentials have been shifted by the level shifter 32. During a non-selection period in which no shift pulse is outputted, the output circuit 33 supplies, from the liquid crystal drive supply voltages V0 through V5, a non-selection voltage pattern for each of the shift pulses whose electric potentials have been shifted by the level shifter 22. The output circuit 33 causes two values of the alternating signal FR to output one of the selection voltage pattern and the non-selection voltage pattern which are reverse to each other. For example, the output circuit 33 selects (i) the voltage V5 as a selection state and (ii) the voltage V1 as a non-selection state when the alternating signal FR is 0 (zero). The output circuit 33 selects (i) the voltage V0 as the selection state and (ii) the voltage V4 as the non-selection state when the alternating signal FR is 1.

The output circuit 33 carries out an output operation when the display control signal DISP is "H" and stops carrying out the output operation when the display control signal DISP is "L".

In order to reset a display state, each of the segment driver 2 and the common driver 3 carries out a reset drive operation with respect to the liquid crystal panel 1 by the conventional drive method.

The controller 4 outputs the display data signals D0 through D3, the data shift clock XCK, the latch pulse LP, the scanning start signal YD, the alternating signal FR, and the display control signal DISP.

The display data signals D0 through D3 are 1-bit data signals for indicating a display level. In sync with one (1) clock of the data shift clock XCK, the shift register 31 transfers in parallel data for the display data signals D0 through D3 as much as four pixels. Further, in sync with the latch pulse LP, the shift register 31 simultaneously serially latches the display data signals D0 through D3 supplied from each transfer stage of the shift register 31. This causes the data for the display data signals D0 through D3, which are parallel, to be serially converted.

The data shift clock XCK sets a timing at which the shift register 21 sequentially shifts the display data signals D0 through D3 for one (1) horizontal period during a reading period followed by a writing period.

The latch pulse LP sets a timing at which the display data signals D0 through D3 (the output data) read by the segment driver 2 are latched. The latch pulse LP further sets a timing at which the shift register 31 of the common driver 3 shifts the scanning start signal YD.

The scanning start signal YD is data transferred by the shift register 31 of the common driver 3 and is a pulse to be outputted at the start of scanning. In a case where one (1) line is sequentially selected, the scanning start signal YD is outputted only once. In contrast, in a case where a plurality of lines are selected, the scanning start signal YD is outputted as many times as the number of N pulses of the latch pulse LP so as to correspond to N lines to be selected.

The alternating signal FR is a binary signal which alternately repeats "0" and "1" so as to select the electric potentials of the common electrode and the segment electrode so that polarities of a voltage to be applied to liquid crystals of each of the pixels cyclically reverse.

The display control signal DISP, which is directed to apply a voltage to the liquid crystal display panel 1, has also been used in a conventional driver. However, according to the conventional driver, the display control signal DISP remains on once the conventional driver is turned on. For example, the display control signal DISP is off in a case where (i) a laptop personal computer or the like is not operating for a given time period, (ii) a display section of the laptop personal computer is closed, or (iii) no display is desired to be carried out with a driver on.

In contrast, according to the liquid crystal display device 11, the display control signal DISP is "L" so that each of the output circuits 23 and 33 of the segment driver 2 and the common driver 3, respectively stops applying a voltage to the liquid crystal display panel 1 during the reading period, whereas the display control signal DISP is "H" so that each of the output circuits 23 and 33 of the segment driver 2 and the common driver 3, respectively applies a voltage to the liquid crystal display panel 1 during the reading period.

The power supply circuit 5 outputs a supply voltage to be applied to each of the segment driver 2 and the common driver 3. The power supply circuit 5 generates the liquid crystal drive supply voltages V0 through V5 (V0<V1<V2<V3<V4<V5) as supply voltages of a drive system (see (a) and (b) of FIG. 4). The power supply circuit 5 resistively divides a reference voltage of 40V so as to obtain a plurality of voltages. Then, the power supply circuit 5 outputs the plurality of voltages via an operational amplifier, so as to obtain the liquid crystal drive supply voltages V0 through V5. The power supply circuit 5 further outputs a logic supply voltage VDD as a supply voltage of the logic system.

It is to be described here how the liquid crystal display device 11 as arranged above operates during the display reset operation.

First, the display reset operation is carried out with respect to a plurality of simultaneously selected lines.

In this case, the shift register 31 of the common driver causes the latch pulse LP to sequentially shift the scanning start signal YD which is outputted N times (N pulses). N shift pulses which have been shifted by a pulse width of the latch pulse LP are supplied from the respective outputs of the shift register 31. The N shift pulses are supplied to the output circuit 33 via the level shifter 32.

Note here that the following description discusses how the liquid crystal display device 11 operates by a conventional drive method in which no output control is carried out by the display control signal DISP.

The output circuit 33 selects, from the liquid crystal drive supply voltages V0 through V5, one (1) voltage indicating a selection state for the N shift pulses supplied to the output circuit 33, so as to output the one (1) voltage as a selection voltage. Specifically, the output circuit 33 selects and outputs the voltage V5 when the alternating signal FR is 0 (zero), and selects and outputs the voltage V0 when the alternating signal FR is 1. The output circuit 33 selects one (1) voltage of the liquid crystal drive supply voltages V0 through V5, so as to supply the one (1) voltage as a non-selection voltage to a common electrode to which no shift pulse is supplied.

In this case, the shift register 21 of the segment driver 2 causes the data shift clock XCK to sequentially shift the display data signals D0 through D3 for the display reset. The display data signals D0 through D3 thus shifted are supplied from the respective outputs of the shift register 21 to the latch 24 as display data shifted by one (1) period of the data shift clock XCK. The display data supplied to the latch 24 is latched in sync with a fall edge of the latch pulse LP, so as to be supplied to the output circuit 23 via the level shifter 22.

The output circuit 23 latches the supplied output data at a timing of a fall of the latch pulse LP (see a period T1 illustrated in FIG. 5). Then, the output circuit 23 selects, from the liquid crystal drive supply voltages V0 through V5, one (1) voltage indicated by the latched output data, so as to output the one (1) voltage during the writing period (see a period T2 illustrated in FIG. 5). In a case where the white display data is written during a period in which the alternating signal FR is "0", the voltage V0 is selected to be outputted (see (a) of FIG. 4). In contrast, in a case where the white display data is written during a period in which the alternating signal FR is "1", the voltage V5 is selected to be outputted (see (b) of FIG. 4). In a case where the black display data is written during the period in which the alternating signal FR is "0", the voltage V2 is selected to be outputted (see (a) of FIG. 4). In contrast, in a case where the black display data is written during the period in which the alternating signal FR is "1", the voltage V3 is selected to be outputted (see (b) of FIG. 4).

In a case where the white display data is written, to liquid crystals of pixels belonging to each of the plurality of selected lines, a negative voltage −Vp (=V0−V5) is applied during the period in which the alternating signal FR is "0" and a positive voltage Vp (=V5−V0) is applied during the period in which the alternating signal FR is "1". In contrast, in a case where the black display data is written, to liquid crystals of pixels belonging to each of the plurality of selected lines, a negative voltage −Vfc (=V2−V5) is applied during the period in which the alternating signal FR is "0" and a positive voltage Vfc (=V3−V0) is applied during the period in which the alternating signal FR is "1".

According to the conventional drive method, all the lines are first subjected to writing of the white display data and then subjected to writing of the black display data.

The voltage V1 is selected to be supplied from the output circuit 33 to a line in the non-selection state during the period in which the alternating signal FR is "0". In contrast, the voltage V4 is selected to be supplied from the output circuit 33 to the line in the non-selection state during the period in which the alternating signal FR is "1". According to this, as for the white display data, to liquid crystals of each of pixels belonging to the line in the non-selection state, a negative voltage −Vc (=V0−V1) is applied during the period in which the alternating signal FR is "0" and a positive voltage Vc (=V5−V4) is applied during the period in which the alternating signal FR is "1". In contrast, as for the black display data, to liquid crystals of each of pixels belonging to the line in the non-selection state, a positive voltage Vc (=V2−V1) is applied during the period in which the alternating signal FR is "0" and a negative voltage −Vc (=V3−V4) is applied during the period in which the alternating signal FR is "1".

Each of the voltages applied to the liquid crystals in the non-selection state is lower than a threshold for changing a display state of the liquid crystals. Accordingly, each of the pixels belonging to the line in the non-selection state maintains the previous display state.

As described earlier, writing is carried out with respect to pixels belonging to the selected N lines from the first line to the Nth line during the display reset operation. Similarly, writing is sequentially carried out with respect to subsequent lines from a (N+1)th line to a 2Nth line, from a (2N+1)th line to a 3Nth line, . . . for every N lines.

Since a shift pulse obtained by a shift of the scanning start signal YD by one (1) pulse width of the latch pulse LP causes the first line to be out of the selection state, no excess voltage is substantially outputted during the period T1 of 1H which period follows the period T2 (see FIG. 10). However, since a shift pulse obtained by a shift of the scanning start signal YD by N pulse widths of the latch pulse LP causes the Nth line to be out of the selection state, an excess voltage is outputted during the period T1 of 1H which period follows the period T2 (see FIG. 10). A voltage which is half the voltage applied in the Nth line is outputted as an excess voltage in a line between the first line and the Nth line.

As described earlier, in a case where the N lines from the first line to the Nth line are simultaneously selected so as to carry out the display reset operation, the first line and the Nth line are different in waveform of a selection signal for one horizontal period (1H) (see FIG. 5). This causes display unevenness as mentioned above (see FIG. 6).

In contrast, according to the liquid crystal display device 11, the display control signal DISP which is "L" during the period T1 illustrated in FIG. 5 is supplied to the respective output circuits 21 and 31, so that the output circuits 21 and 31 stop carrying out the respective output operations. The display control signal DISP which is "H" during the period T2 in which writing is carried out with respect to the liquid crystal display panel 1 is supplied to the respective output circuits 21 and 31, so that the output circuits 21 and 31 carry out the respective output operations.

According to this, no voltage is supplied from each of the segment driver 2 and the common driver 3 to the liquid crystal display panel 1 during the period T1. This causes no voltage to be applied to the liquid crystal display panel 1 during the period T1 in which data necessary for writing is read. In contrast, a voltage is applied to the liquid crystal display device 1 during the period T2 in which writing is carried out. Therefore, signals whose waveforms are nonuniform (see FIG. 10) and which have been supplied to the common electrode during the period T1 following the period T2 are not outputted during shaded periods illustrated in FIG. 5. Accordingly, selection signals whose waveforms are identical are supplied during the period T2 to pixels belonging to each of the simultaneously selected lines.

Note that the logic supply voltage VDD continues to be supplied from the power supply circuit 5 during the period T1. Therefore, during the period T1, the segment driver 2 can import the display data signals D0 through D3 into the shift register 21, so as to cause the level shifter 22 to output the display data signals D0 through D3. During the period T1, the common driver 3 can import the scanning start signal YD into the shift register 31, so as to cause the level shifter 32 to output the scanning start signal YD. This allows the writing operation to be carried out with respect to the liquid crystal display panel 1 during the period T2 as in the case of a normal display operation.

As described earlier, according to the liquid crystal display device 11, during the period T1 in which the display reset operation is carried out, voltages (drive signal waveforms) to be applied to the liquid crystal display panel 1 can be identical between simultaneously selected lines by causing the output circuits 21 and 31 to stop carrying out the respective output operations. This can prevent display unevenness from occurring between the simultaneously selected lines (see FIG. 6).

Figure 2:
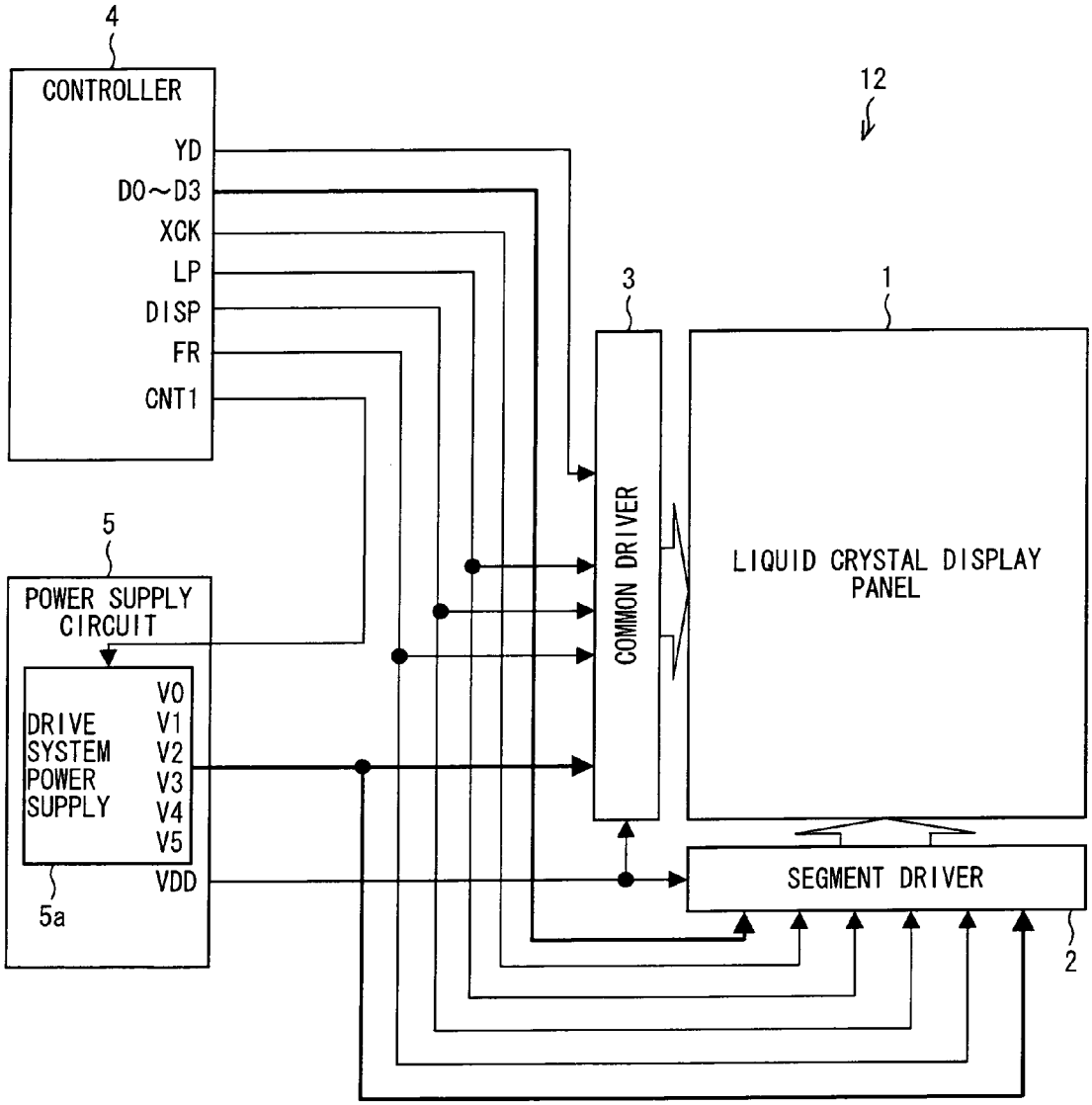
FIG. 2 is a block diagram illustrating an arrangement of a liquid crystal display device showing a second embodiment of the present invention.
Figure 3:
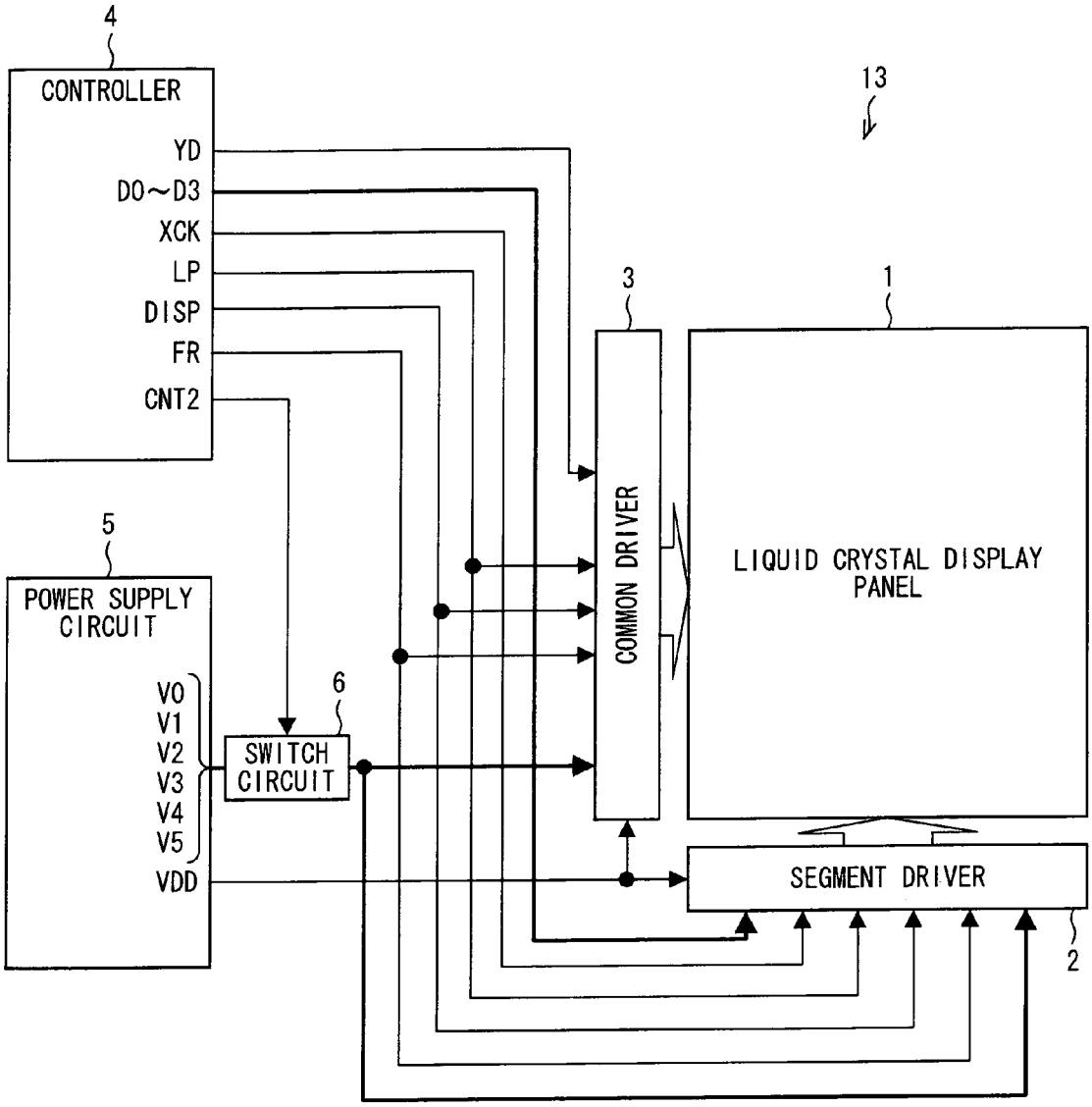
FIG. 3 is a block diagram illustrating an arrangement of a liquid crystal display device showing a third embodiment of the present invention.

Subsequently, alternative embodiments for preventing display unevenness are described below with reference to FIGS. 2 and 3.

Note that members having functions identical to those of the respective members of the liquid crystal display device of the first embodiment are given respective identical reference numerals, and a description of those members is omitted in the alternative embodiments.

A liquid crystal display device 12 (see FIG. 2) is arranged such that during a period T1, a power supply circuit 5 stops a drive system power supply 5*a* from outputting liquid crystal drive supply voltages V0 through V5. Such an arrangement is different from the arrangement of the liquid crystal display device 11 such that the display control signal DISP causes the output circuits 21 and 31 to stop carrying out their respective output operations during the period T1. Therefore, not the signal which was used in the liquid crystal display device 11 and is "L" during the period T1 but a conventional signal which is "H" during the period T is used as a display control signal DISP. The drive system power supply 5*a* includes an on/off circuit (not illustrated) which causes its output to turn on/off. The drive system power supply 5*a* causes a control signal CNT1 supplied from a controller 4 to stop outputting the liquid crystal drive supply voltages V0 through V5 when the on/off circuit causes the output to turn off during the period T1. The drive system power supply 5*a* allows the control signal CNT1 supplied from the controller 4 to output the liquid crystal drive supply voltages V0 through V5 when the on/off circuit causes the output to turn on during a period T2.

As described above, during the period T1, no voltage is applied to a liquid crystal display panel 1 since none of the liquid crystal drive supply voltages V0 through V5 are outputted. During the period T2, since the liquid crystal drive supply voltages V0 through V5 are outputted, a voltage is applied to the liquid crystal display panel 1, so that writing is carried out in accordance with signals obtained by shift registers 21 and 31 and level shifters 22 and 32 each of which was operating during the period T1.

Accordingly, as in the case of the liquid crystal display device 11, voltages (drive signal waveforms) to be applied to the liquid crystal display panel 1 can be identical between simultaneously selected lines during the period T1 in which the display reset operation is carried out. This can prevent display unevenness from occurring between the simultaneously selected lines (see FIG. 6).

In contrast, as in the case of the liquid crystal display device 12, according to a liquid crystal display device 13 (see FIG. 3), output lines, through which respective liquid crystal drive supply voltages V0 through V5 are supplied from a power supply circuit 5 to each of a segment driver 2 and a common driver 3, turn off during the period T1. Such an arrangement is different from the arrangement of the liquid crystal display device 11 such that the display control signal DISP causes the output circuits 21 and 31 to stop carrying out their respective output operations during the period T1. Specifically, the liquid crystal display device 13 includes a switch circuit 6 which causes the output lines to turn on/off. The switch circuit 6 causes a control signal CNT2 supplied from a controller 4 to turn off the output lines during the period T1, so as to stop the liquid crystal drive supply voltages V0 through V5 from being outputted. The switch circuit 6 causes the output lines to turn on during the period T2, so as to allow the liquid crystal drive supply voltages V0 through V5 to be outputted.

As described above, during the period T1, no voltage is applied to a liquid crystal display panel 1 since none of the liquid crystal drive supply voltages V0 through V5 are outputted. During the period T2, since the liquid crystal drive supply voltages V0 through V5 are outputted, a voltage is applied to the liquid crystal display panel 1, so that writing is carried out in accordance with signals obtained by shift registers 21 and 31 and level shifters 22 and 32 each of which was operating during the period T1.

Accordingly, as in the case of the liquid crystal display device 11, voltages (drive signal waveforms) to be applied to the liquid crystal display panel 1 can be identical between simultaneously selected lines during the period T1 in which the display reset operation is carried out. This can prevent display unevenness from occurring between the simultaneously selected lines (see FIG. 6).

[Summary of Embodiments]

A liquid crystal display drive circuit in accordance with each of the present embodiments, which is provided in a cholesteric liquid crystal display device in which (i) pixels are provided at intersections of a plurality of common electrodes and a plurality of segment electrodes and (ii) each line is defined by pixels belonging to a corresponding one of the plurality of common electrodes, the liquid crystal display drive circuit includes: a common driver in which a selection signal for selecting a common electrode is generated in accordance with a plurality of liquid crystal drive supply voltages by sequentially shifting a scanning start signal; a segment driver in which a writing signal to be supplied to a segment electrode is generated in accordance with display data; and an output control section which (i) during a reading period, causes an output circuit to stop outputting the selection signal and the writing signal while causing the scanning start signal to continue to be shifted and (ii) during a writing period, allows the output circuit to output the selection signal and the writing signal, the reading period being a period in which (i) the scanning start signal is shifted so that the selection signal is generated with respect to a plurality of lines by the common driver and (ii) the display data is read so that the writing signal to be used for a reset operation is generated by the segment driver, the writing period being a period in which the writing signal to be used for the reset operation is outputted.

The liquid crystal display drive is preferably arranged such that the output control means includes a stop control section which causes the output circuit to stop carrying out the output operation during the reading period.

The liquid crystal display drive circuit is preferably arranged such that the output control section further includes a supply voltage output control section which during the reading period, causes a power supply circuit to stop carrying out an output operation in which the plurality of liquid crystal drive supply voltages are outputted.

The liquid crystal display drive circuit is preferably arranged such that the output control section further includes (i) a switch circuit which causes output lines, through which the respective plurality of liquid crystal drive supply voltages are outputted, to turn on/off and (ii) an output line control section which causes the switch circuit to turn off during the reading period.

A liquid crystal display device includes a liquid crystal display drive circuit mentioned above. This allows provision of a liquid crystal display device which can prevent an occurrence of display unevenness during the reset operation, as described earlier.

Note that the above description of the present embodiments discussed three methods for prevention of display unevenness with reference to the liquid crystal display devices 11 through 13. However, a method for stopping an application of a liquid crystal drive voltage is not limited to these embodiments. Note also that in the liquid crystal display device 11, the display control signal DISP causes the output circuits 21 and 31 to stop carrying out their output operations during the period T1. Alternatively, another control signal can similarly cause the output circuits 21 and 31 to stop carrying out their output operations.

The present invention is not limited to the description of the embodiments above, but may be altered by a skilled person within the scope of the claims. An embodiment based on a proper combination of technical means disclosed in different embodiments is encompassed in the technical scope of the present invention.

INDUSTRIAL APPLICABILITY

A liquid crystal display device of the present invention can be suitably used to enhance a display quality in a liquid crystal display device. This is because in order to carry out a display reset operation, a memory (e.g., cholesteric) liquid crystal display device stops a segment driver and a common driver from applying respective voltages to a liquid crystal panel during a period in which display data is read, so as to (i) cause signal waveforms to be applied to the liquid crystal display panel to be uniform between lines and (ii) prevent display unevenness.

REFERENCE SIGNS LIST

1 Liquid crystal display panel
2 Segment driver
3 Common driver
4 Controller (Output control means, Stop control means, Supply voltage output control means, Output line control means)
5 Power supply circuit
5*a* Drive system power supply
6 Switch circuit
11-13 Liquid crystal display device
T1 Period (Reading period)
T2 Period (Writing period)

The invention claimed is:

1. A liquid crystal display drive circuit which is provided in a cholesteric liquid crystal display device in which (i) pixels are provided at intersections of a plurality of common electrodes and a plurality of segment electrodes and (ii) each line is defined by pixels belonging to a corresponding one of the plurality of common electrodes, said liquid crystal display drive circuit comprising:

a common driver in which a selection signal for selecting a common electrode is generated in accordance with a plurality of liquid crystal drive supply voltages by sequentially shifting a scanning start signal;

a segment driver in which a writing signal to be supplied to a segment electrode is generated in accordance with display data: and an output controller which (i) during a reading period, causes an output circuit to stop outputting the selection signal and the writing signal while causing the scanning start signal to continue to be shifted and (ii) during a writing period, allows the output circuit to output the selection signal and the writing signal, the reading period being a period in which (i) the scanning start signal is shifted so that the selection signal is generated with respect to a plurality of lines by the common driver and (ii) the display data is read so that the writing signal to be used for a reset operation is generated by the segment driver, the writing period being a period in which the writing signal to be used for the reset operation is outputted, wherein the output controller further includes a supply voltage output controller, which during the reading period, causes a power supply circuit to stop carrying out an output operation in which the plurality of liquid crystal drive supply voltages are outputted.

2. A liquid crystal display device comprising a liquid crystal display drive circuit recited in claim 1.

3. A liquid crystal display drive circuit which is provided in a cholesteric liquid crystal display device in which (i) pixels are provided at intersections of a plurality of common electrodes and a plurality of segment electrodes and (ii) each line is defined by pixels belonging to a corresponding one of the plurality of common electrodes, said liquid crystal display drive circuit comprising:

a common driver in which a selection signal for selecting a common electrode is generated in accordance with a plurality of liquid crystal drive supply voltages by sequentially shifting a scanning start signal;

a segment driver in which a writing signal to be supplied to a segment electrode is generated in accordance with display data; and an output controller which (i) during a reading period, causes an output circuit to stop outputting the selection signal and the writing signal while causing the scanning start signal to continue to be shifted and (ii) during a writing period, allows the output circuit to output the selection signal and the writing signal, the reading period being a period in which (i) the scanning start signal is shifted so that the selection signal is generated with respect to a plurality of lines by the common driver and (ii) the display data is read so that the writing signal to be used for a reset operation is generated by the segment driver, the writing period being a period in which the writing signal to be used for the reset operation is outputted, wherein the output controller further includes (i) a switch circuit which causes output lines, through which the respective plurality of liquid crystal drive supply voltages are outputted, to turn on/off and (ii) an output line controller which causes the switch circuit to turn off during the reading period.

4. A liquid crystal display device comprising a liquid crystal display drive circuit recited in claim 3.

* * * * *